US009080466B2

(12) United States Patent
Kluge et al.

(10) Patent No.: US 9,080,466 B2
(45) Date of Patent: Jul. 14, 2015

(54) METHOD AND SYSTEM FOR CONTROLLING A VALVE OF A TURBOMACHINE

(75) Inventors: Steven Craig Kluge, Burnt Hills, NY (US); Dean Alexander Baker, Clifton Park, NY (US); Dileep Sathyanarayana, Clifton Park, NY (US); Steven Di Palma, Sterling, MA (US)

(73) Assignee: General Electric Company, Schenectady, NY (US)

( * ) Notice: Subject to any disclaimer, the term of this patent is extended or adjusted under 35 U.S.C. 154(b) by 1112 days.

(21) Appl. No.: 12/969,861

(22) Filed: Dec. 16, 2010

(65) Prior Publication Data

US 2012/0151925 A1 Jun. 21, 2012

(51) Int. Cl.

| | |
|---|---|
| ***F01K 13/02*** | (2006.01) |
| ***F01K 21/06*** | (2006.01) |
| ***F01K 3/00*** | (2006.01) |
| ***F01K 7/22*** | (2006.01) |

(52) U.S. Cl.
CPC .. *F01K 13/02* (2013.01); *F01K 7/22* (2013.01)

(58) Field of Classification Search
USPC ..... 60/645, 646, 652; 415/1
See application file for complete search history.

(56) References Cited

U.S. PATENT DOCUMENTS

| | | | | |
|---|---|---|---|---|
| 4,228,359 | A | 10/1980 | Matsumoto et al. | |
| 4,267,458 | A * | 5/1981 | Uram et al. | 290/40 R |
| 4,320,625 | A | 3/1982 | Westphal et al. | |
| 4,329,592 | A | 5/1982 | Wagner et al. | |
| 4,353,216 | A | 10/1982 | Dickenson | |
| 4,561,254 | A | 12/1985 | Martens et al. | |
| 4,589,255 | A | 5/1986 | Martens et al. | |
| 4,957,410 | A | 9/1990 | Silvestri, Jr. | |
| 4,965,221 | A | 10/1990 | Dennison et al. | |
| 5,018,356 | A | 5/1991 | Silvestri et al. | |
| 5,042,246 | A | 8/1991 | Moore et al. | |

(Continued)

FOREIGN PATENT DOCUMENTS

| | | | |
|---|---|---|---|
| DE | 4418224 | A1 | 3/1995 |
| DE | 102007029573 | A1 | 1/2008 |

(Continued)

OTHER PUBLICATIONS

European Search Report issued in connection with corresponding EP Application No. 11192401.5 on Jan. 22, 2014.

(Continued)

*Primary Examiner* — Christopher Jetton
(74) *Attorney, Agent, or Firm* — Ernest G. Cusick; Frank A. Landgraff

(57) ABSTRACT

A method and a system for limiting steam flow entering a steam turbine are provided. The method and system may intentionally unbalance the steam flow apportioned between sections of the steam turbine. The steam turbine comprises at least: a first section, a second section, and a rotor disposed within each section. The method may receive a speed/load command, or the like, which provides reference strokes for a first valve, associated with the first section; and a second valve, associated with the second section. The method may also determine an operational parameter that may limit the reference strokes relative to the speed/load command. The operational parameter may determine the allowable steam flow for each section of steam turbine, independent of the speed/load command.

10 Claims, 6 Drawing Sheets

(56) References Cited

U.S. PATENT DOCUMENTS

| | | | |
|---|---|---|---|
| 5,361,585 | A | 11/1994 | Westphal et al. |
| 6,647,728 | B2 | 11/2003 | Seitz |
| 6,939,100 | B2 | 9/2005 | Kirchhof |
| 7,028,479 | B2 | 4/2006 | Gobrecht et al. |
| 7,632,059 | B2 | 12/2009 | Tisenchek et al. |

FOREIGN PATENT DOCUMENTS

| | | | |
|---|---|---|---|
| GB | 1265841 | A | 3/1972 |
| JP | 61212607 | A | 9/1986 |
| JP | 62189304 | A | 8/1987 |
| JP | 08296405 | A | 11/1996 |
| WO | 9915887 | A1 | 4/1999 |
| WO | 0157366 | A1 | 8/2001 |
| WO | 0192689 | A1 | 12/2001 |

OTHER PUBLICATIONS

Office Action issued in connection with related CN Application No. 201110436233.2 on Aug. 26, 2014.

* cited by examiner

300

METHOD AND SYSTEM FOR CONTROLLING A VALVE OF A TURBOMACHINE

This application is related to commonly-assigned U.S. patent application Ser. No. 12/969,876, filed Dec. 16, 2010; U.S. patent application Ser. No. 12/969,889, filed Dec. 16, 2010; and U.S. patent application Ser. No. 12/969/906, filed Dec. 16, 2010.

BACKGROUND

The present invention relates generally to turbomachines; and more particularly to a method and a system for independently limiting the steam flow entering a section of a steam turbine.

Steam turbines are commonly used in power plants, heat generation systems, marine propulsion systems, and other heat and power applications. Steam turbines typically include at least one section that operates within a pre-determined pressure range. This may include: a high-pressure (HP) section; and a reheat or intermediate pressure (IP) section. The rotating elements housed within these sections are commonly mounted on an axial shaft. Generally, control valves and intercept valves control steam flow through the HP and the IP sections, respectively.

The normal operation of a steam turbine includes three distinct phases; which are startup, loading, and shutdown. The startup phase may be considered the operational phase beginning in which the rotating elements begin to roll until steam is flowing through all sections. Generally, the startup phase does not end at a specific load. The loading phase may be considered the operational phase in which the quantity of steam entering the sections is increased until the output of the steam turbine is approximately a desired load; such as the rated load. The shutdown phase may be considered the operational phase in which the steam turbine load is reduced, and steam flow into each section is gradually stopped and the rotor, upon which the rotating elements are mounted, is slowed to a turning gear speed.

Some steam turbine operators employ a balanced flow strategy, during most of the loading phase. This strategy seeks to supply equal amounts of steam flow through each section. Here, a control system controls the steam flow via a command that positions the associated valves. Other control schemes are commonly used during the startup and shutdown operational phases.

During a startup of a steam turbine integrated with a cascade bypass system, steam may be diverted through a bypass valve to an intercept valve, while the control valve is substantially closed. Here, the intercept valve may perform the initial speed/load control of the steam turbine. Then, at a predetermined load range, the control valve primarily provides the speed/load control, while the intercept valve is biased open. Other operations may result in the significant loading of the IP section while steam flow into the HP section is considerably reduced. Consequently, the unbalanced flow may increase the net thrust on the rotor.

There are a few issues, with known methods of controlling the steam turbine during the startup, loading, and shutdown operational phases. Currently known methods may be disadvantageously conservative. These methods can reduce operational flexibility, require larger mechanical components, and potentially reduce the net-output delivered by the steam turbine. Therefore, there is a desire for a method and a system for increasing the operational flexibility of the steam turbine.

BRIEF DESCRIPTION OF THE INVENTION

In accordance with an embodiment of the present invention, a method of limiting the steam flow entering a turbomachine, wherein the turbomachine comprises a rotor disposed within a first and a second section, wherein a flow path around the rotor allows for steam to fluidly communicate between the first section and the second section, a first valve configured for controlling steam flow entering the first section and a second valve configured for controlling steam flow entering the second section, the method comprising: receiving a command, wherein the command provides reference strokes for the first valve and the second valve and determining an operational parameter, wherein the operational parameter is configured for limiting the reference strokes of the first valve and the second valve relative to the command, wherein the operational parameter controls steam flow, to at least one of the first section or the second section, independently of the command.

In accordance with an alternate embodiment of the present invention, a method of increasing the operational flexibility of a power plant, wherein the power plant comprises a steam turbine, wherein the steam turbine comprises a HP section, a rotor partially disposed therein, wherein a flow path around the rotor allows for steam to fluidly communicate within the HP section and engage the rotor, a first valve configured for controlling steam flow entering the HP section, the method comprising: receiving a speed/load command wherein the speed/load command provides a reference stroke for the first valve and determining an operational parameter wherein the operational parameter is configured for limiting the stroke of the first valve relative to the speed/load command, wherein the operational parameter controls steam flow to the HP section independently of the speed/load command.

In accordance with another alternate embodiment of the present invention, a system for increasing the operational flexibility of a power plant, the system comprising: a power plant comprising a steam turbine, wherein the steam turbine comprises a housing, a rotor partially disposed therein, wherein a flow path around the rotor allows for steam to travel within the housing and to engage the rotor, a first valve configured for controlling steam flow entering the housing and a control system configured for performing the steps of: receiving a speed/load command wherein the speed/load command provides a reference stroke for the first valve and determining an operational parameter wherein the operational parameter is configured for limiting the stroke of the first valve relative to the speed/load command, wherein the operational parameter controls the reference stroke of the first valve independently of the speed/load command.

DETAILED DESCRIPTION OF THE INVENTION

Figure 1:
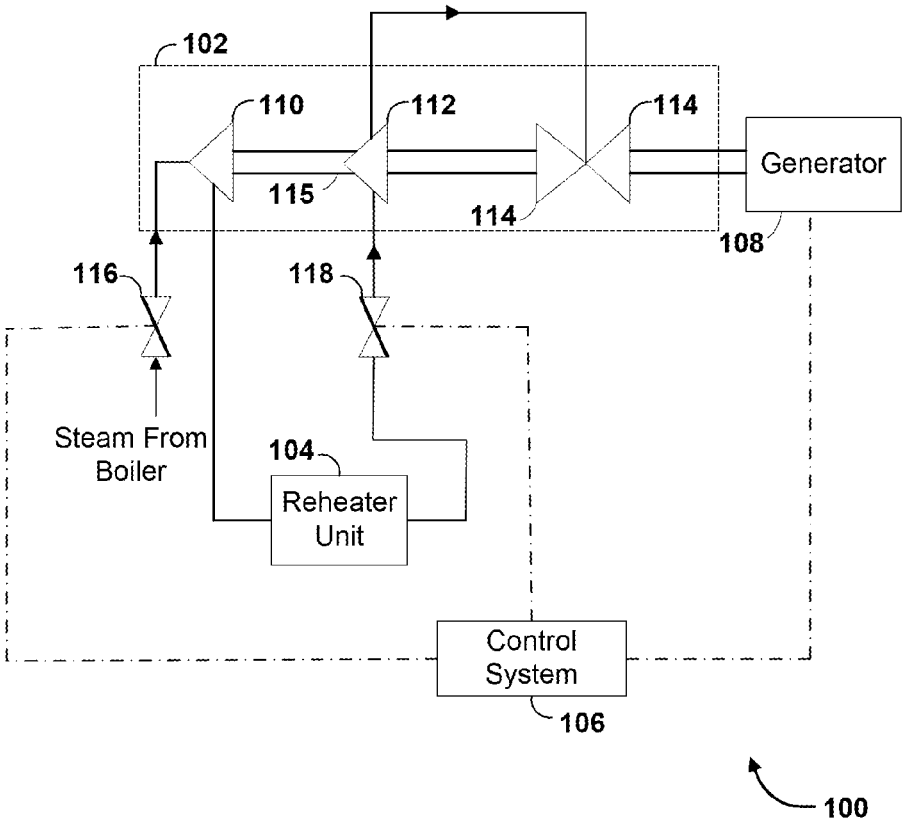
FIG. 1 is a schematic illustrating a powerplant site, of which an embodiment of the present invention may operate.

The present invention has the technical effect of increasing the operational flexibility of a steam turbine by providing methods and systems for independently controlling the steam flow entering each section. The benefits of this methodology may include, but are not limited to: maintaining axial thrust loads within allowable limits, increasing operational flexibility, providing a dynamic approach to expanding operational boundaries.

The following detailed description of preferred embodiments refers to the accompanying drawings, which illustrate specific embodiments of the invention. Other embodiments having different structures and operations do not depart from the scope of the present invention.

Certain terminology may be used herein for the convenience of the reader only and is not to be taken as a limitation on the scope of the invention. For example, words such as "upper", "lower", "left", "right", "front", "rear", "top", "bottom", "horizontal", "vertical", "upstream", "downstream", "fore", "aft", and the like; merely describe the configuration shown in the Figures. Indeed, the element or elements of an embodiment of the present invention may be oriented in any direction and the terminology, therefore, should be understood as encompassing such variations unless specified otherwise.

Detailed example embodiments are disclosed herein. However, specific structural and functional details disclosed herein are merely representative for purposes of describing example embodiments. Example embodiments may, however, be embodied in many alternate forms, and should not be construed as limited to only the embodiments set forth herein.

Accordingly, while example embodiments are capable of various modifications and alternative forms, embodiments thereof are illustrated by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any, and all, combinations of one or more of the associated listed items.

The terminology used herein is for describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

The present invention may be applied to a variety of steam turbines. An embodiment of the present invention may be applied to either a single steam turbine or a plurality of steam turbines.

Referring now to FIGURES, where the various numbers represent like elements through the several views, FIG. 1 is a schematic illustrating a steam turbine 102 deployed in a site 100, such as, but not limiting of: a power plant site 100. FIG. 1 illustrates the site 100 having the steam turbine 102, a reheater unit 104, a control system 106, and an electric generator 108.

As illustrated in FIG. 1, the steam turbine 102 may include a first section 110 and a second section 112. In various embodiments of the present invention, the first section 110, and the second section 112 of the steam turbine 102 may be a high pressure (HP) section 110, an intermediate pressure (IP) section 112. In various other embodiments of the present invention, the HP section 110 may also be referred to as a housing 110 and the IP section 112 may also be referred to as an additional housing 112. Further, the steam turbine 102 may also include a third section 114. In an embodiment of the present invention, the third section 114 may be a low pressure (LP) section 114. The steam turbine 102 may also include a rotor 115, which may be disposed within the first, second and third sections 110, 112 and 114 of the steam turbine 102. In an embodiment of the present invention, a flow path around the rotor 115 may allow the steam to fluidly communicate between the HP section 110 and the IP section 112.

As illustrated in FIG. 1, the steam turbine 102 may include a first valve 116 and a second valve 118 for controlling the steam flow entering the first section 110 and the second section 112, respectively. In various embodiments of the present invention, the first valve 116 and the second valve 118 may be a control valve 116 and an intercept valve 118 for controlling the steam flow entering the HP section 110 and the IP section 112, respectively.

During the operation of the steam turbine 102, steam extracted from the HP section 110 may flow through the reheater unit 104 where the temperature of the steam is raised before flowing into the IP section 112. Subsequently, the steam may be extracted from the reheater unit 104, via the intercept valve 118, and flow into the IP section 112 and the LP section 114, as illustrated in FIG. 1. Then the steam may exit work the IP section 112 and the LP section 114, and flow into a condenser (not illustrated in FIGURES).

Figure 2:
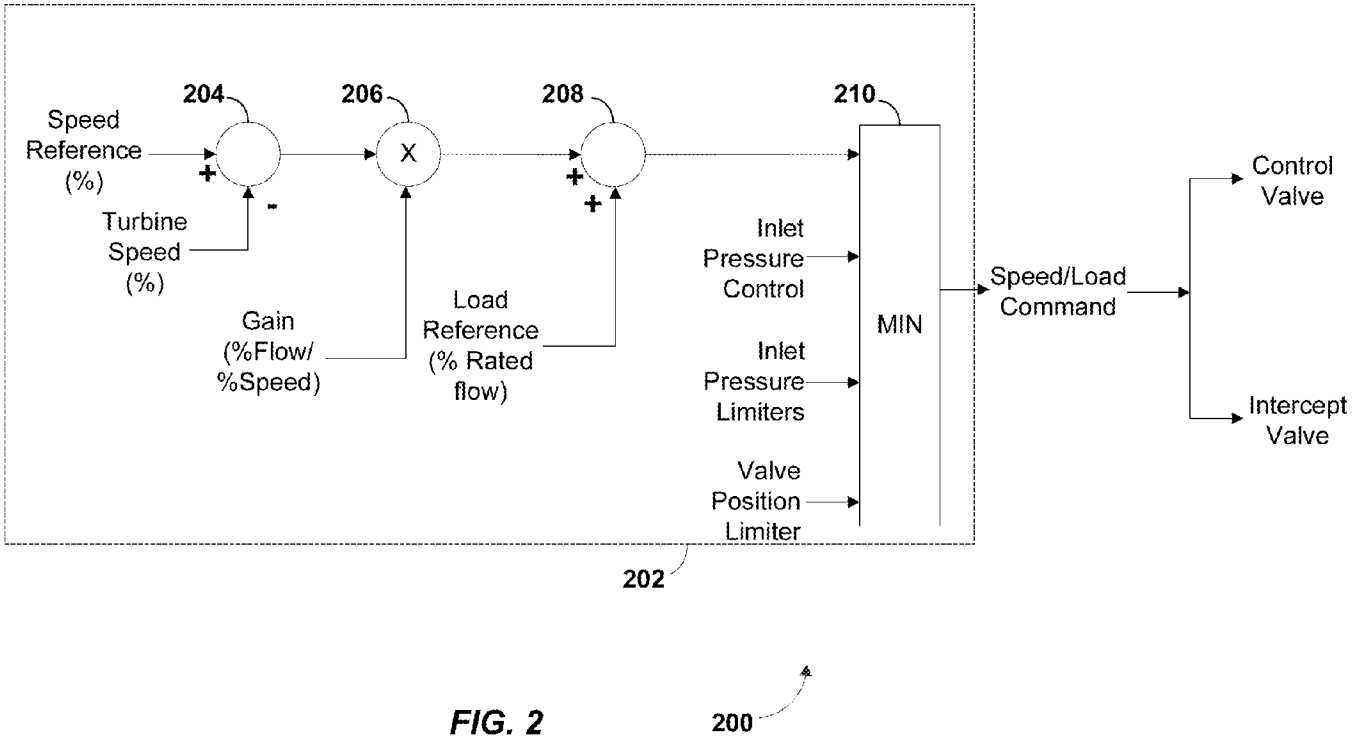
FIG. 2 PRIOR ART
FIG. 2 is a schematic illustrating a conventional system employed for controlling steam flow entering a steam turbine.

FIG. 2 is schematic illustrating a conventional system 200 for controlling the steam flow entering the steam turbine 102. FIG. 2 and the related discussion herein, represents a known methodology. As illustrated in FIG. 2, the system 200 may include a speed/load governor 202. The speed/load governor 202 may generate a speed/load command that may control the steam flow through the HP section 110 and the IP section 112.

As illustrated in FIG. 2, a comparator block 204 generates an error signal after comparing the actual speed of the steam turbine 102 with a reference speed of the steam turbine 102. A multiplier block 206 then receives the output of the comparator block 204. Here, the error signal is multiplied with a gain to generate an error regulation signal. This serves to establish a relationship between the error signal and the current load of the steam turbine 102. Next, a summing junction 208 receives the output of the multiplier block 206; and a turbine load reference. The summing junction 208 then generates a flow reference signal. Then, a minimum select block 210 receives the output of the summing junction 208. Other inputs to the minimum select block 210 may include other functions such as, but are not limiting of: inlet pressure control, inlet pressure limiters, valve position limiters, or the like. The minimum select block 210 compares the input signals, selects, and then outputs the most limiting value of the input signal. Here, the output may be considered the speed/load command.

As illustrated in FIG. 2, the speed/load command may generate reference commands for stroking the control valve 116 and the intercept valve 118. Subsequently, the system 200 may apply the reference strokes to the control valve 116 and the intercept valve 118. This known methodology typically yields substantially equal steam flows through the HP section 110 and the IP section 112. This known methodology may also result in lesser operational flexibility of the steam turbine 102.

FIGS. 3 through 6 are schematics illustrating systems and methods for independently controlling the steam flow entering the steam turbine 102, in accordance with embodiments of the present invention. As discussed, balanced flow may be considered a methodology and/or control philosophy that seeks to provide the same quantity of steam flow to each section 110,112. Embodiments of the present invention incorporate an unbalanced flow method and/or control philosophy. Here, the steam flow entering each section 110,112 may be intentionally unbalanced to control operation of the steam turbine to its true boundaries, thus increasing the operational flexibility of the turbine 102. This may be accomplished by independently controlling the amount of steam entering each section 110,112, in real-time. Embodiments of the present invention may provide a separate flow limiter, or the like, for each section 110,112. These flow limiters may act independently on the respective valves (CVs, IVs) that substantially control the steam flow entering each section 110,112.

Embodiments of the present invention may be integrated with portions of known methodologies and control philosophies. This may allow the speed/load control schemes (or the like) to remain active, as the steam flow between each section the steam turbine 110,112 is intentionally unbalanced via a limiting action.

Figure 3:
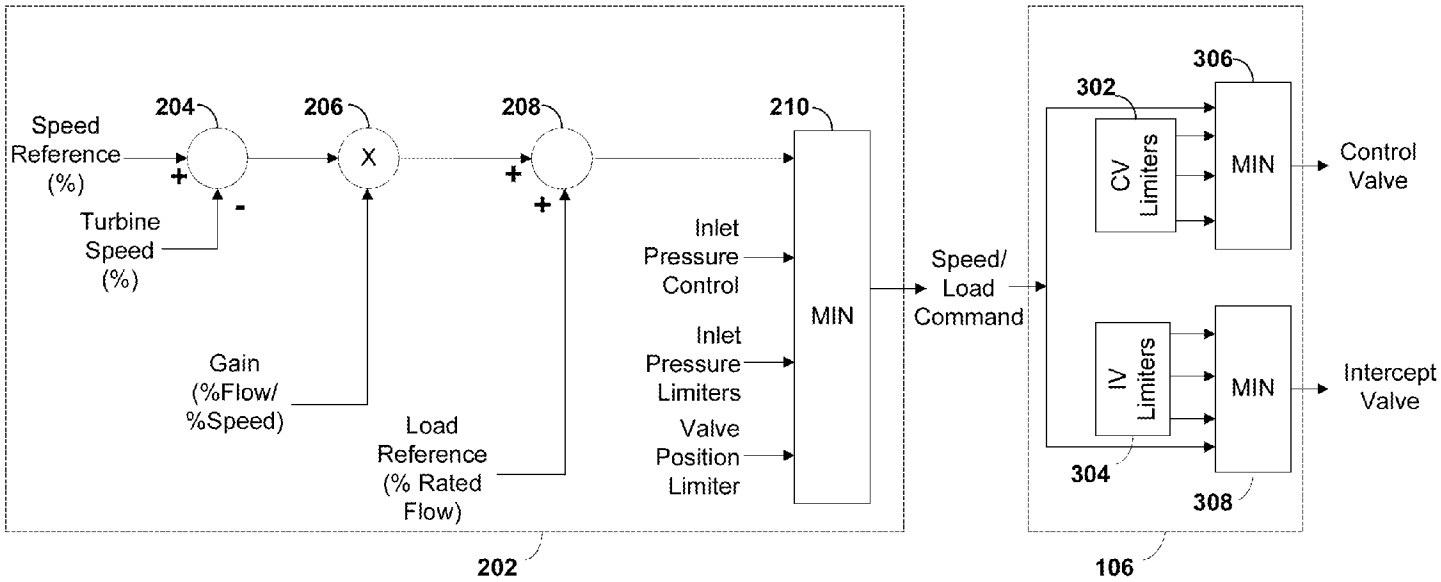
FIG. 3 is a schematic illustrating a system for limiting the steam flow entering the steam turbine, in accordance with an embodiment of the present invention.

FIG. 3 is a schematic illustrating a system 300 for limiting the steam flow entering the steam turbine, in accordance with an embodiment of the present invention. A control system 106, also illustrated in FIG. 1, may receive the speed/load command generated by the speed/load governor 202. Other embodiments may provide a control system 106 that does not receive a speed/load command.

The control system 106 may be configured for controlling the first valve 116 and the second valve 118. In an embodiment of the present invention, the control system 106 may determine a speed/load command and the reference strokes for the first valve 116 and the second valve 118. The control system 106 may also be configured to determine an operational parameter associated with the first section 110; and an operational parameter associated with the second section 112. The operational parameter may include, but is not limiting of: axial thrust, rotor stress, steam pressure, or the like. In an embodiment of the present invention, the operational parameter is based, at least in part, on one or more physical requirements. The physical requirement may include, but are not limiting of: pressure, a temperature, a flow rate, or combinations thereof.

After determining each operational parameter, the control system 106 may individually limit the reference strokes of the first valve 116 and the second valve 118 based, at least in part, on the operational parameter. These operations may individually control the steam flow entering the HP section 110 and the IP section 112, independent of the speed/load command.

As illustrated in FIG. 3, an embodiment of the control system 106 may include flow limiters 302 and 304; which function to limit the steam flow into the respective section 110,112, based on the determined operational parameter. The flow limiter 302 may be a control valve flow limiter (hereinafter referred as 'CV flow limiter 302') for limiting steam flow in the HP section 110. The flow limiter 304 may be an intercept valve flow limiter (hereinafter referred as 'IV flow limiter 304') for limiting steam flow in the IP section 112.

In an embodiment of the present invention, the control system 106 may also include minimum select blocks 306 and 308 for selecting a minimum value between the speed/load command and the output of the flow limiters 302 and 304. Then, the control system 106 may determine the reference strokes for the control valve 116 and the intercept valve 118 based on the minimum selected value. In an embodiment of the present invention, the minimum select block 306 may select a minimum value between the speed/load command and the output of the CV flow limiter 302. Here, the control system 106 may utilize the minimum value to determine the reference strokes for the control valve 116. Similarly, the minimum select block 308 may select a minimum value between the speed/load command and the output of the IV flow limiter 304. Then, the control system 106 may utilize the minimum value to determine the reference strokes for the intercept valve 118.

Figure 4:
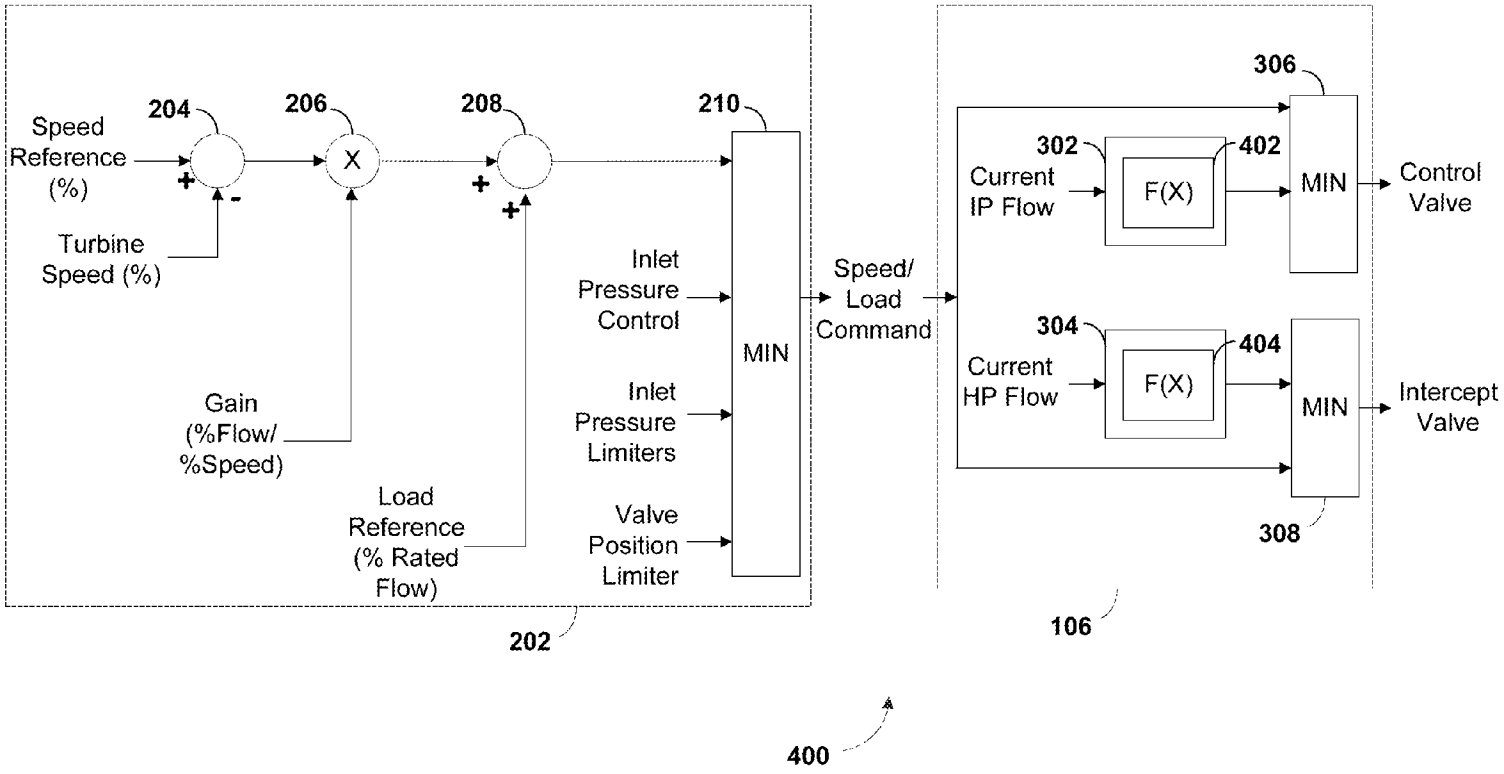
FIG. 4 is a schematic illustrating another system for limiting the steam flow entering the steam turbine, in accordance with an alternate embodiment of the present invention.

FIG. 4 is a schematic illustrating another system for limiting the steam flow entering the steam turbine 102, in accordance with an alternate embodiment of the present invention. As illustrated in FIG. 4, the control system 106 may receive the speed/load command generated by the speed/load governor 202, as discussed. Then, the control system 106 may include limiter modules 402 and 404 that employ transfer function algorithms. The limiter module 402 may be an element of the flow limiter 302 to control the steam flow in the HP section 110 and the limiter module 404 may be provided in the flow limiter 304 to control the steam flow in the IP section 112.

In an embodiment of the present invention, the transfer function algorithm may determine a value of the operational parameter. The transfer function algorithm may be configured to independently control the steam flow into the first section 110 and/or the second section 112 of the steam turbine 102. In an embodiment of the present invention, the transfer function algorithm may limit the steam flow based on at least one of: a transient condition, the condition of the power plant, or a physical requirement. The physical requirement may include, but is not limiting of: pressure, temperature, flow rate, or combinations thereof.

In an embodiment of the present invention, the transfer function algorithm may be configured to determine the values of the maximum allowable steam flow in the HP section 110 and the maximum allowable steam flow in the IP section 112 corresponding to current operating conditions. Here, the CV flow limiter 302 may continuously monitor the steam flow in the HP section 110. The CV flow limiter 302 may also track whether the steam turbine 102 is operating within the dynamic operational boundaries. Specifically, the CV flow limiter 302 may compare the actual steam flow in the HP section 110 with the allowable steam flow of the HP section 110. Here, if the current steam flow in the HP section 110 is less than the allowable steam flow in the HP section 110, then the control system 106 may increase the output of the CV flow limiter 302.

In use, during an initial startup, the output of the CV flow limiter 302 may be initially set to a value greater than the speed/load command generated by the minimum select block 210. Then, the minimum select block 306 may select the minimum of the speed/load command and the output of the CV flow limiter 302. Thus, the control valve 116 may be regulated based on the speed/load command from the minimum select block 210. However, when the current steam flow in the HP section 110 is greater than or equal to the allowable steam flow of the HP section 110, the output of the CV flow limiter 302 may change from the initial set value. The limiting action may not be required if the current steam flow in the HP section 110 is less than the allowable steam flow in the HP section 110. In an embodiment of the present invention, the IV flow limiter 304 may also perform similar limiting action.

In an embodiment of the present invention, the limiting action performed by the CV flow limiter 302 may reduce the rotor stresses that occur during a cascading bypass startup, or similar operation, by limiting steam flow through the control valve 116. Thus, steam flow may be unbalanced, allowing each section 110,112 to operate within its own operational boundaries. This intentional unbalanced approach may increase the operational flexibility of the steam turbine the 102.

As will be appreciated, the present invention may be embodied as a method, system, or computer program product. Accordingly, the present invention may take the form of an entirely hardware embodiment, an entirely software embodiment (including firmware, resident software, micro-code, etc.) or an embodiment combining software and hardware aspects all generally referred to herein as a "circuit", "module," or "system". Furthermore, the present invention may take the form of a computer program product on a computer-usable storage medium having computer-usable program code embodied in the medium.

Any suitable computer readable medium may be utilized. The computer-usable or computer-readable medium may be, for example but not limiting of, an electronic, magnetic, optical, electromagnetic, infrared, or semiconductor system, apparatus, device, or propagation medium. More specific examples (a non exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present invention may be written in an object oriented programming language such as Java7, Smalltalk or C++, or the like. However, the computer program code for carrying out operations of the present invention may also be written in conventional procedural programming languages, such as the "C" programming language, or a similar language. The program code may execute entirely on the user's computer, partly on the user's computer, as a stand-alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider).

The present invention is described below with reference to flowchart illustrations and/or block diagrams of methods, apparatuses (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a public purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block.

The present invention may include the control system 106, or the like, that has the technical effect of limiting the steam flow entering the steam turbine 102. The present invention may be configured to automatically determine the reference strokes for the control valve 116 and the intercept valve 118. Alternatively, the control system 106 may be configured to require a user action to the initiate operation. An embodiment of the control system 106 of the present invention may function as a stand-alone system. Alternatively, the control system 106 may be integrated as a module, or the like, within a broader system, such as, but is not limiting of, a turbomachine control or a steam power plant control system.

Figure 5:
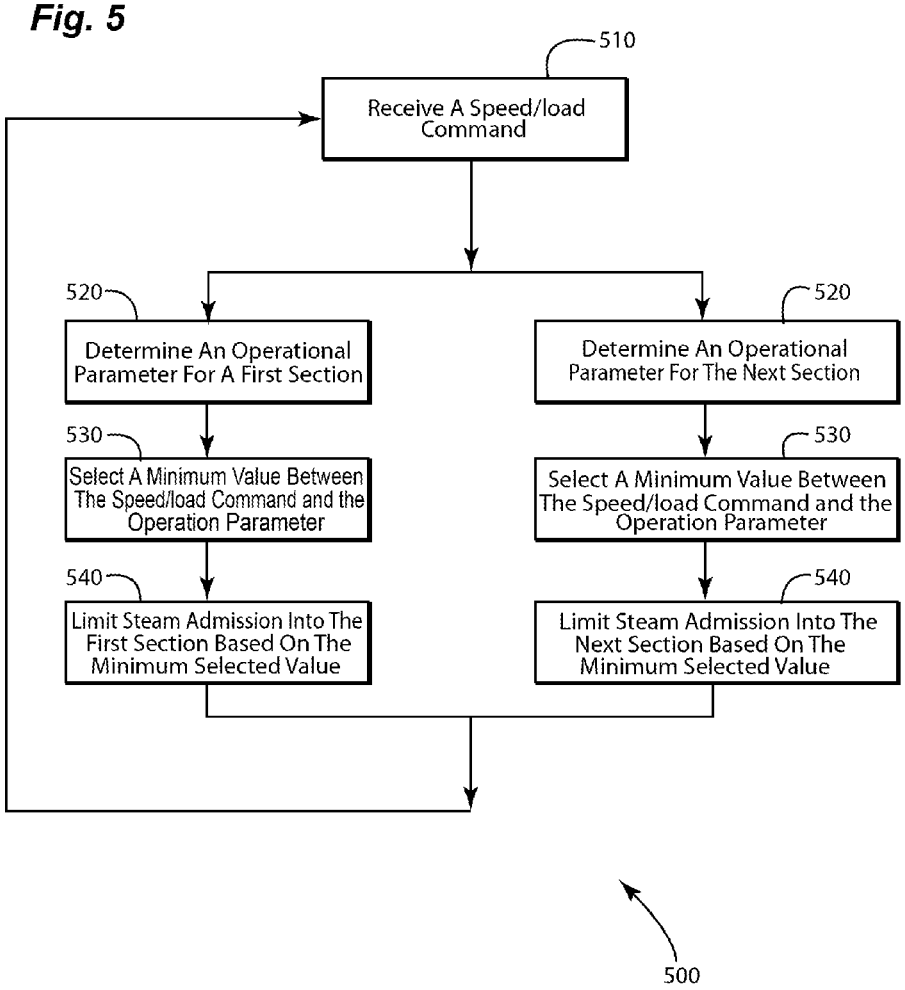
FIG. 5 is a flowchart illustrating an example of a method for limiting the steam flow entering the steam turbine, in accordance with another alternate embodiment of the present invention.

Referring now to FIG. 5 is a flowchart illustrating an example of a method 500 for limiting the steam flow entering the steam turbine, in accordance with another alternate embodiment of the present invention. The method 500 may be provided with the steam turbine 102, such as, but not limiting of: a steam turbine, or the like. In an embodiment of the present invention, the steam turbine 102 may comprise the steam turbine 102 deployed in the site 100, such as a power plant site. The steam turbine 102 may include the first section 110. In an embodiment of the present invention, the steam turbine may also include the second section 112. Further, the rotor 115 may be partially disposed within the first section 110. The flow path around the rotor 115 may allow the steam to fluidly communicate within the first section 110 and engage the rotor 115. In an embodiment of the present invention, the rotor 115 may be partially disposed between the first section 110 and the second section 112, as discussed. In an embodiment of the present invention the steam turbine 102 may also comprise a third section 114. The third section 114 may be considered a LP section 114, as illustrated in FIG. 1.

The method 500 may operate the first valve 116 for controlling steam flow through the first section 110. The method 500 may also operate the second valve 118 for controlling steam flow through the second section 112. Here, the first valve 116 and the second valve 118 may be in the form of a control valve 116 and an intercept valve 118; which may control steam flow entering the HP section 110 and the IP section 112, respectively.

In step 510, the method 500 may receive the speed/load command. The speed/load command may provide reference strokes for the first valve 116. In an embodiment of the present invention, the speed/load command may also provide reference strokes for the second valve 118. The speed/load command may be generated using the speed/load governor 202. In an embodiment of the present invention, the method 500 may enable the control system 106 to receive the speed/load command from the speed/load governor 202.

In step 520, the method 500 may determine the individual operational parameter for each section 110, 112. As discussed, the operational parameter may include, but is not limited to: axial thrust, rotor stress, steam pressure, or the like. In addition, the operational parameter may be based, at least in part, on the physical requirement such as, but not limiting of: pressure, temperature, flow rate or combinations thereof. In an embodiment of the present invention, the method may enable the control system 106 to determine the operational parameter. The operational parameter may be configured for limiting the reference stroke of the first valve 116 relative to the speed/load command. In an embodiment of the present invention, the operational parameter may be configured for limiting the reference strokes of the first valve 116 and the second valve 118, relative to the speed/load command.

In step 530, the method 500 may select a minimum value between the speed/load command and the operational parameter.

In step 540, the method 500 may limit the steam admission into each section 110, 112 based on the minimum selected value. Here, the control system 106 may determine the reference strokes for the first valve 116 and the second valve 118 based on the minimum value; which may be independent of the speed/load command.

An embodiment of the method 500 may incorporate a transfer function algorithm to determine a value, or a range of values, of the operational parameter. The transfer function algorithm may be configured for independently limiting steam flow into at least one of the first section 110 or the second section 112 of the steam turbine 102. In an embodiment of the present invention, the transfer function algorithm may be configured for independently limiting steam flow into the HP section 110 and/or the IP section 112.

Figure 6:
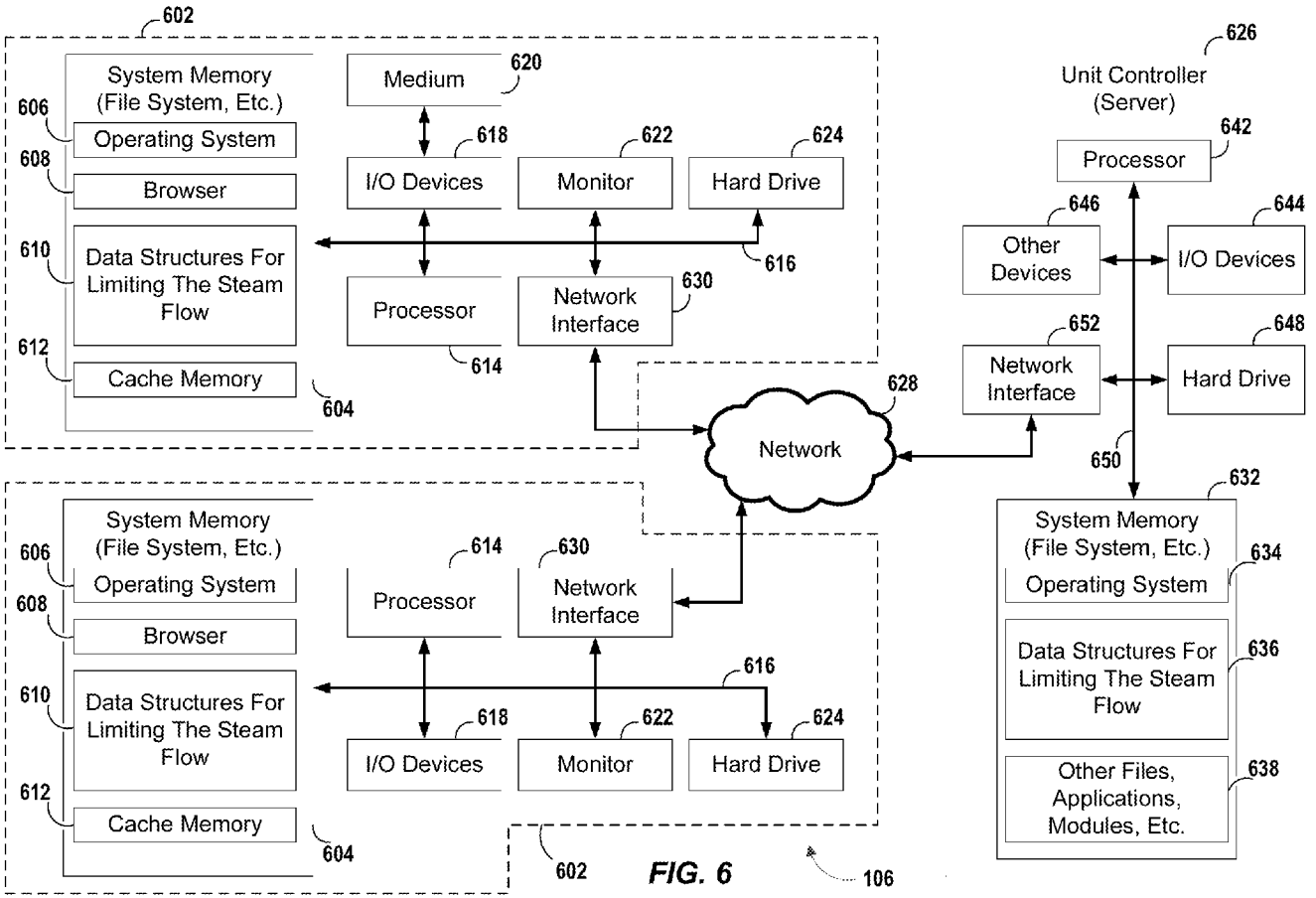
FIG. 6 is a block diagram of a control system for limiting the steam flow entering the steam turbine, in accordance with an embodiment of the invention.

FIG. 6 is a block diagram of a non-limiting example of the control system 106 for limiting steam flow entering the steam turbine 102, in accordance with an embodiment of the present invention. Embodiments of the present invention may be implemented by a control means, or the like, that is not illustrated in FIG. 6. This other control means may incorporate, but is not limited to: mechanical systems, pneumatic systems, analog systems, electro-mechanical systems, electrical systems, electronic systems, digital systems, or any combinations thereof.

Referring now to FIG. 6, the elements of the method 500 may be embodied in and performed by the control system 106. The control system 106 may include one or more user or client communication devices 602 or similar systems or devices (two are illustrated in FIG. 6). Each communication device 602 may be for example, but not limiting of, a computer system, a personal digital assistant, a cellular phone, or similar device capable of sending and receiving an electronic message.

The communication device 602 may include a system memory 604 or a local file system. The system memory 604 may include for example, but is not limiting of, a read only memory (ROM) and a random access memory (RAM). The ROM may include a basic input/output system (BIOS). The BIOS may contain basic routines that help to transfer information between elements or components of the communication device 602. The system memory 604 may contain an operating system 606 to control overall operation of the communication device 602. The system memory 604 may also include a browser 608 or web browser. The system memory 604 may also include data structures 610 or computer-executable code for limiting the steam flow entering the steam turbine 102 that may be similar or include elements of the method 500 in FIG. 5.

The system memory 604 may further include a template cache memory 612, which may be used in conjunction with the method 500 in FIG. 5 for limiting the steam flow entering the steam turbine 102 and for increasing operational flexibility.

The communication device 602 may also include a processor or processing unit 614 to control operations of the other components of the communication device 602. The operating system 606, browser 608, and data structures 610 may be operable on the processing unit 614. The processing unit 614 may be coupled to the memory system 604 and other components of the communication device 602 by a system bus 616.

The communication device 602 may also include multiple input devices (I/O), output devices or combination input/output devices 618. Each input/output device 618 may be coupled to the system bus 616 by an input/output interface (not illustrated). The input and output devices or combination I/O devices 618 permit a user to operate and interface with the communication device 602 and to control operation of the browser 608 and data structures 610 to access, operate and control the software to limit the steam flow entering the steam turbine 102. The I/O devices 618 may include a keyboard and computer pointing device or the like to perform the operations discussed herein.

The I/O devices 618 may also include for example, but not limiting of, disk drives, optical, mechanical, magnetic, or infrared input/output devices, modems or the like. The I/O devices 618 may be used to access a storage medium 620. The medium 620 may contain, store, communicate, or transport computer-readable or computer-executable instructions or other information for use by or in connection with a system, such as the communication devices 602.

The communication device 602 may also include or be connected to other devices, such as a display or monitor 622. The monitor 622 may permit the user to interface with the communication device 602.

The communication device 602 may also include a hard drive 624. The hard drive 624 may be coupled to the system bus 616 by a hard drive interface (not illustrated). The hard drive 624 may also form part of the local file system or system memory 604. Programs, software, and data may be transferred and exchanged between the system memory 604 and the hard drive 624 for operation of the communication device 602.

The communication device 602 may communicate with a unit controller 626 and may access other servers or other communication devices similar to communication device 602 via a network 628. The system bus 616 may be coupled to the network 628 by a network interface 630. The network interface 630 may be a modem, Ethernet card, router, gateway, or the like for coupling to the network 628. The coupling may be a wired or wireless connection. The network 628 may be the Internet, private network, an intranet, or the like.

The unit controller 626 may also include a system memory 632 that may include a file system, ROM, RAM, and the like. The system memory 632 may include an operating system 634 similar to operating system 606 in communication devices 602. The system memory 632 may also include data structures 636 for limiting the steam flow entering the steam turbine 102. The data structures 636 may include operations similar to those described with respect to the method 500 for limiting the steam flow entering the steam turbine 102 and for increasing the operational flexibility of the power plant. The server system memory 632 may also include other files 638, applications, modules, and the like.

The unit controller 626 may also include a processor or a processing unit 642 to control operation of other devices in the unit controller 626. The unit controller 626 may also include I/O device 644. The I/O devices 644 may be similar to I/O devices 618 of communication devices 602. The unit controller 626 may further include other devices 646, such as a monitor or the like to provide an interface along with the I/O devices 644 to the unit controller 626. The unit controller 626 may also include a hard disk drive 648. A system bus 650 may connect the different components of the unit controller 626. A network interface 652 may couple the unit controller 626 to the network 628 via the system bus 650.

The flowcharts and step diagrams in the Figures illustrate the architecture, functionality, and operation of possible implementations of systems, methods and computer program products according to various embodiments of the present invention. In this regard, each step in the flowchart or step diagrams may represent a module, segment, or portion of code, which comprises one or more executable instructions for implementing the specified logical function(s). It should also be noted that, in some alternative implementations, the functions noted in the step might occur out of the order noted in the figures. For example, two steps shown in succession may, in fact, be executed substantially concurrently, or the steps may sometimes be executed in the reverse order, depending upon the functionality involved. It will also be noted that each step of the block diagrams and/or flowchart illustration, and combinations of steps in the block diagrams and/or flowchart illustration, can be implemented by special purpose hardware-based systems which perform the specified functions or acts, or combinations of special purpose hardware and computer instructions.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

As one of ordinary skill in the art will appreciate, the many varying features and configurations described above in relation to the several embodiments may be further selectively applied to form other possible embodiments of the present invention. Those in the art will further understand that all possible iterations of the present invention are not provided or discussed in detail, even though all combinations and possible embodiments embraced by the several claims below or otherwise are intended to be part of the instant application. In addition, from the above description of several embodiments of the invention, those skilled in the art will perceive improvements, changes, and modifications. Such improvements, changes, and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

What is claimed is:

1. A method of limiting steam flow entering a steam turbine, the method comprising:

providing a steam turbine comprising a rotor disposed within a first section and a second section, wherein a flow path around the rotor allows for steam to fluidly communicate between the first section and the second section;

providing a first valve configured for controlling steam flow entering the first section; and a second valve configured for controlling steam flow entering the second section;

receiving a command that provides reference strokes for the first valve and the second valve;

determining an operational parameter, wherein the operational parameter limits the reference strokes relative to the command;

selecting a minimum value between the command and the operational parameter; wherein the minimum value determines reference strokes of the first valve and the second valve; and wherein the operational parameter independently controls the steam flow to and of at least one of the first section or the second section, wherein the independently controls is independent of the command, and the operational parameter is based on a physical requirement that comprises at least one of: a pressure, a temperature, a flow rate, or combinations thereof; and wherein the operational parameter comprises at least one of: axial thrust, rotor stress, steam pressure, or a physical range.

2. The method of claim 1, wherein a value of the operational parameter is determined by a transfer function algorithm, which is configured for independently limiting the steam flow into at least one of: the first section or the second section.

3. The method of claim 2, wherein the transfer function algorithm limits the steam flow based on at least one of: a transient condition, a plant condition, or the physical requirement.

4. The method of claim 1, wherein the first section comprises a HP section and the section second comprises an IP section.

5. A method of increasing the operational flexibility of a power plant, the method comprising:

providing a power plant comprising a steam turbine, wherein the steam turbine comprises a HP section and a rotor partially disposed therein, wherein a flow path around the rotor allows for steam to fluidly communicate within the HP section and engage the rotor;

providing a first valve configured for controlling steam flow entering the HP section;

receiving a speed/load command; wherein the speed/load command provides a reference stroke for the first valve;

determining an operational parameter; wherein the operational parameter is configured for limiting the stroke of the first valve relative to the speed/load command;

independently controlling the steam flow to the HP section;

wherein independently controlling comprises controlling the operational parameter and the steam flow to the HP section independent of the speed/load command, wherein the steam turbine further comprises an IP section and another portion of the rotor is disposed within the IP section, and wherein the flow path integrates the HP and the IP sections and allows the steam to fluidly communicate to between the HP and the IP sections, providing a second valve configured for controlling the steam flow entering the IP section, and further comprising selecting a minimum value between the speed/load command and the operational parameter; wherein the minimum value determines reference strokes of the first valve and the second valve.

6. The method of claim 5, wherein the operational parameter comprises at least one of: axial thrust, rotor stress, steam pressure, or a physical range.

7. The method of claim 6, wherein the physical range comprises at least one of: a pressure, a temperature, a flow rate, or combinations thereof.

8. The method of claim 7, wherein a value of the operational parameter is determined by a transfer function algorithm configured for independently controlling the steam flow into at least one of: the HP section or the IP section.

9. The method of claim 8, wherein the transfer function algorithm limits the steam flow based on at least one of: a transient condition, a plant condition, or the physical range.

10. A system for increasing the operational flexibility of a power plant, the system comprising:

a power plant comprising a steam turbine, wherein the steam turbine comprises a housing and a rotor partially disposed therein, wherein a flow path around the rotor allows for steam to travel within the housing and to engage the rotor;

a first valve configured for controlling steam flow entering the housing;

a control system configured for performing the steps of:

receiving a speed/load command; wherein the speed/load command provides a reference stroke for the first valve;

determining an operational parameter; wherein the operational parameter is configured for limiting the stroke of the first valve relative to the speed/load command; and selecting a minimum value between the speed/load command and the operational parameter; wherein the minimum value determines reference strokes of the first valve and the second valve;

wherein the operational parameter independently controls the reference stroke of the first valve, and wherein the control is independent of the turbine and speed/loud command, wherein the steam turbine further comprises tin additional housing and another portion of the rotor is disposed therein, and wherein the flow path integrates the housing and the additional housing;

allowing the steam to fluidly communicate to between the housing and the additional housing, and further comprising a second valve configured for controlling the steam flow entering the additional housing.

* * * * *